US007762700B2

(12) United States Patent
Luo et al.

(10) Patent No.: US 7,762,700 B2
(45) Date of Patent: Jul. 27, 2010

(54) REAR-LOADED LIGHT EMITTING DIODE MODULE FOR AUTOMOTIVE REAR COMBINATION LAMPS

(75) Inventors: Hong Luo, Danvers, MA (US); ZhaoHuan Liu, Mississauga (CA)

(73) Assignee: OSRAM SYLVANIA Inc., Danvers, MA (US)

( * ) Notice: Subject to any disclaimer, the term of this patent is extended or adjusted under 35 U.S.C. 154(b) by 165 days.

(21) Appl. No.: 12/259,725

(22) Filed: Oct. 28, 2008

(65) Prior Publication Data

US 2009/0296416 A1 Dec. 3, 2009

Related U.S. Application Data

(60) Provisional application No. 61/056,738, filed on May 28, 2008.

(51) Int. Cl.
*F21S 8/10* (2006.01)

(52) U.S. Cl. ..... 362/545; 362/517; 362/294

(58) Field of Classification Search ..... 362/545, 362/487, 555, 346, 348, 350, 294, 517, 518, 362/519

See application file for complete search history.

(56) References Cited

U.S. PATENT DOCUMENTS 3,700,883 A 10/1972 Donohue et al.
4,704,661 A 11/1987 Kosmatka
5,406,464 A 4/1995 Saito
5,539,629 A 7/1996 Chinniah et al.
6,474,852 B1 11/2002 Ohkohdo et al.
6,637,921 B2 10/2003 Coushaine
6,637,923 B2 10/2003 Amano
6,814,475 B2 11/2004 Amano
6,945,672 B2 9/2005 Du et al.
6,951,414 B2 10/2005 Amano
6,991,355 B1 1/2006 Coushaine et al.
7,042,165 B2 5/2006 Madhani et al.
7,075,224 B2 7/2006 Coushaine
7,110,656 B2 9/2006 Coushaine et al.

OTHER PUBLICATIONS

Gu et al., 2004, Design and evaluation of an LED-based light fixture, Third International Conference on Solid State Lighting, Proceedings of SPIE 5187: 318-329.

*Primary Examiner*—Gunyoung T Lee
(74) *Attorney, Agent, or Firm*—Shaun P. Montana

(57) ABSTRACT

A rear-loading LED module for a rear combination lamp is disclosed. One or more LEDs are mounted on a printed circuit board that mechanically holds them at the focus of a faceted, parabolic reflector. Light from the LEDs diverges transversely and horizontally, and is collimated by the reflector, and the reflected collimated light is directed in a generally longitudinal direction out of the rear combination lamp, toward the viewer. The LED module itself is generally longitudinally oriented, and is insertable longitudinally into the interior of the reflector from a hole at the vertex of the reflector. The printed circuit board, an optional thermal pad adjacent to the printed circuit board, and a thermally conductive layer adjacent to the optional thermal pad are all generally planar layers, are all generally parallel to each other, and may optionally all have the same footprint. Together, the printed circuit board, the thermal pad and the thermally conductive layer may all form a generally planar ledge.

17 Claims, 11 Drawing Sheets

REAR-LOADED LIGHT EMITTING DIODE MODULE FOR AUTOMOTIVE REAR COMBINATION LAMPS

CROSS-REFERENCE TO RELATED APPLICATIONS

The present application claims priority under 35 U.S.C §119(e) to provisional application No. 61/056,738, filed on May 28, 2008 under the title, "Side entry LED light module for automotive rear combination lamp," and incorporated by reference herein in its entirety. Full Paris Convention priority is hereby expressly reserved.

STATEMENT REGARDING FEDERALLY SPONSORED RESEARCH OR DEVELOPMENT

Not Applicable

BACKGROUND OF THE INVENTION

1. Field of the Invention

The present invention is directed to rear combination lamps for automotive lighting systems.

2. Description of the Related Art

For many years, automobiles have employed electric lighting that serves a variety of functions. For instance, lights provide forward illumination (headlamps, auxiliary lamps), conspicuity (parking lights in front, taillights in rear), signaling (turn signals, hazards, brake lights, reversing lights), and convenience (dome lights, dashboard lighting), to name only a few applications. Historically, incandescent bulbs have been used for most or all lighting in an automobile, being available in a variety of sizes, shapes, wattages, and socket packages.

In recent years, light emitting diodes (LEDs) have started to appear in some of the lighting applications for automobiles. Compared with incandescent bulbs, LEDs use less power, last longer, and have less heat output, making them well suited for automotive applications.

In the relatively short time period since LEDs have been introduced as lighting sources, automakers have adopted a cautious position. While they have been eager to adopt LEDs for all of the advantages stated above, they have been hesitant to completely abandon the familiarity of a bulb/lamp with a socket and its accompanying traditional-style optics. As a result, in recent years there have been several lighting subsystems that have the mechanical feel of the old incandescent-style bulbs and fixtures, but actually use LEDs as their light sources.

FIG. 1 shows a typical automobile 1, with typical exterior lights that front turn indicators 2, include headlamps 3, fog lamps 4, side repeaters 6, a center high mounted stop lamp 7, a license plate lamp 8, and so-called "rear combination lamps" 9 (RCLs). Any or all of these may include accessories, such as a headlamp cleaning system 5. We concentrate primarily on the rear combination lamps 9 for this application.

Note that each rear combination lamp 9 may include a tail light (also known as a marker light), a stop light (also known as a brake light), a turn signal light, and a back up light. Each light in the rear combination lamp may have its own light source, its own reflection and/or focusing and/or collimation and/or diffusing optics, its own mechanical housing, its own electrical circuitry, and so forth. In this respect, an aspect or feature of one particular light may be used for any or all of the lights in the rear combination lamp 9. Optionally, one or more functions may be shared among lights, such a circuit that controls more than one light source, or a mechanical housing that holds more than one light source, and so forth. For instance, each lighting sub-system typically has its own independent lamp, although the tail light and stop light functions may be combined in a single lamp (bulb) having a double filament.

In recent years, as LEDs have started to appear in exterior automotive lighting systems, one trend is to integrate the LEDs closely into the fixture. For instance, the center high mount stop lamps 7, or CHSMLs, are now mostly done in this fashion as it was relatively easy to adapt an LED module to the application. Because of the long life of LEDs, this may be the favored approach over time.

In other words, in the long term, the light fixtures, including the housing, the reflectors, the lens cover and any intermediate optical elements, will most likely become adapted to a configuration that is designed optimally around the LED. The electrical connections, the heat sink, the collimation and/or reflection and/or diffusing optics will most likely have designs that are primarily suited to LEDs, rather than primarily to conventional incandescent bulbs or lamps and then modified to include LED light sources.

However, in the short term, many automakers prefer familiar and known technology, including known reflector and bulb geometries that were developed for incandescent lamps and have been used for many years. As a result, several lighting manufacturers have developed rear combination lamp systems that use LEDs as their light sources, but use conventional light set socket openings and traditional style optics. The lamp is accessible from the back, i.e., from the side opposite the viewer, as is conventional with older incandescent systems. These lamp systems are appealing to automakers in the short term because the mechanical aspects of the lamp systems are consistent with the older, established systems that use incandescent bulbs. An example of such a lamp system is the JOULE product, which is commercially available from Osram Sylvania, based in Danvers, Mass.

There have been various designs for these lamp systems that use LED sources but have the mechanical feel of the older incandescent systems. Each of these designs had some drawbacks, such as difficulty during assembly, or a low optical efficiency, caused by losses.

An example of one of these known designs is disclosed in U.S. Pat. No. 6,991,355, issued on Jan. 31, 2006 to Coushaine et al., and assigned to OSRAM Sylvania Inc., based in Danvers, Mass. In this design, various LEDs 22 are attached to one side of a printed circuit board 20, and a heat sink 25 is attached to the other side of the printed circuit board 20. The LEDs 22, circuit board 20 and heat sink 25 are all located outside a concave reflector 50, adjacent to the base (vertex) of the reflector. Light from each LED 22 is directed into the interior of the reflector 50 via a respective light guide 30 that extends from the LED 22 through a hole at the vertex of the reflector 50. The exiting face of each light guide 30 is located at the focus of the reflector 50, so that light emitted from an LED 22 enters the light guide 30, exits the light guide 30 at the focus of the reflector 50, reflects off the reflector 50 and emerges from the lamp as a collimated beam. One of the designs uses a curved light guide 30*a*, so that the exiting face of the light guide is oriented appropriately, and the light exiting from the light guide travels in a suitable direction and strikes the reflector 50 in a suitable location. Another of the designs uses a straight light guide 30 with an intermediate reflector 26 to direct the light guide output appropriately onto the reflector 50.

In the design of '355, the light guide 30 may be the source of loss. Typical light guides are largely cylindrical rods of plastic or glass, with all surfaces being smooth, or as smooth as possible for a molded component. There may be additional polishing steps performed on the part, but such polishing steps add undesirable expense to the light guide, and therefore, to the whole lamp unit.

The longitudinal faces of the light guide are the entrance and exiting faces, and both may introduce loss. For instance, if the faces are uncoated, there may be a reflection loss of about 4% per surface, due to the difference in refractive index between the rod and air. Such reflection loss may be reduced by applying anti-reflection coatings to the longitudinal faces, but this may add undesirable expense to the light guide, and, therefore, to the whole lamp unit. In addition, there may be additional losses at the longitudinal faces caused by scattering. Such scattering losses may be reduced somewhat by ensuring that the longitudinal faces are relatively smooth, but in practice, these scattering losses are difficult to eliminate.

The transverse face of the light guide is typically left uncoated, so that light propagating along the interior of the light guide experiences total internal reflection at each bounce off the exterior face. There may be scattering losses caused by surface roughness, contaminants, or other imperfections along the transverse face. As with the scattering losses from the longitudinal faces, the scattering losses from the transverse face may be difficult to eliminate.

Accordingly, it would be beneficial to provide a rear combination lamp that uses LEDs as its light source, inserts from the back of the lamp, and eliminates the optical losses and expense of a light guide.

Because the present application is directed to automotive lighting systems, it is beneficial to first review some terminology.

The parts that make up the lighting systems at the corners of vehicles are known as "light sets". In buildings, the equivalent of "light sets" would be fixtures. A light set typically includes a plastic structure or housing, one or more reflectors, lens optical systems in some cases, and a lens cover usually fitting the exterior styling of the vehicle and often having colored sections, such as amber and red. The housing of the light set includes socket openings, usually in the rear, to receive and retain a socket with a lamp (commonly referred to in the U.S. as a "bulb"), venting means, and in some cases for forward lighting, adjuster means.

In general, there are four key elements for an LED-based lighting module: (1) the actual LED chip or die, (2) the heat sink or thermal management, which dissipates the heat generated by the LED chip, (3) the driver circuitry that powers the LED chip, and (4) the optics that receives the light emitted by the LED chip and directs it toward a viewer. These four elements need not be redesigned from scratch for each particular module; instead, a particular lighting module may use one or more elements that are already known. The following paragraphs describe several of these known elements, which may be used with the LED-based lighting module disclosed herein.

U.S. Pat. No. 7,042,165, titled "Driver circuit for LED vehicle lamp", issued to Madhani et al., and assigned to Osram Sylvania Inc. of Danvers, Mass., discloses a known driver circuit for LED-based lighting modules, and is incorporated by reference herein in its entirety. In '165, a first vehicle lamp driver circuit for a light emitting diode (LED) array is disclosed, the LED array having a first string of four LEDs in series and a second string of four LEDs in series. A first LED driver drives the first LED string and a second LED driver drives the second LED string. In a STOP mode of operation, the current to both LED strings is controlled by the LED driver in series with the LED string. In a TAIL mode of operation, the current is provided to only one LED string via a series connected diode and resistor. When there is reduced input voltage, operation of the LED strings is provided by switching circuits that short-out one LED in each LED string. A second vehicle lamp driver circuit comprises a first LED string and a second LED string in series with a control switch having a feedback circuit for maintaining constant current regulation to control the sum of the current in each LED string and reduce switching noise. The driver circuit disclosed by '165 may be used directly or may be easily modified to drive the LED chip for the lighting module disclosed herein.

U.S. Pat. No. 7,110,656, titled "LED bulb", issued to Coushaine et al., and assigned to Osram Sylvania Inc. of Danvers, Mass., discloses a complementary socket and electrical connector mechanical structure for LED-based lighting modules, and is incorporated by reference herein in its entirety. In '656, an LED light source has a housing having a base. A hollow core projects from the base and is arrayed about a longitudinal axis. A printed circuit board is positioned in the base at one end of the hollow core and has a plurality of LEDs operatively fixed thereto about the center thereof. In a preferred embodiment of the invention the hollow core is tubular and the printed circuit board is circular. A light guide with a body that, in a preferred embodiment, is cup-shaped as shown in FIGS. 2 and 4*a*, has a given wall thickness "T". The light guide is positioned in the hollow core and has a first end in operative relation with the plurality of LEDs and a second end projecting beyond the hollow core. The thickness "T" is at least large enough to encompass the emitting area of the LEDs that are employed with it. The complementary socket and electrical connector mechanical structure disclosed by '656 may be used directly or may be easily modified for the lighting module disclosed herein.

U.S. Pat. No. 7,075,224, titled "Light emitting diode bulb connector including tension receiver", issued to Coushaine et al., and assigned to Osram Sylvania Inc. of Danvers, Mass., discloses another complementary socket and electrical connector mechanical structure for LED-based lighting modules, and is incorporated by reference herein in its entirety. In '224, an LED light source (10) comprises a housing (12) having a base (14) with a hollow core (16) projecting therefrom. The core (16) is substantially conical. A central heat conductor (17) is centrally located within the hollow core (16) and is formed from solid copper. A first printed circuit board (18) is connected to one end of the central heat conductor and a second printed circuit board (20) is fitted to a second, opposite end of the central heat conductor (17). The second printed circuit board (20) has at least one LED (24) operatively fixed thereto. A plurality of electrical conductors (26) has proximal ends (28) contacting electrical traces formed on the second printed circuit board (20) and distal ends (30) contacting electrical traces on the first printed circuit board (18). Each of the electrical conductors (26) has a tension reliever (27) formed therein which axially compresses during assembly. A cap (32) is fitted over the second printed circuit board (20); and a heat sink (34) is attached to the base and in thermal contact with the first printed circuit board. As with '656, the complementary socket and electrical connector mechanical structure disclosed by '224 may be used directly or may be easily modified for the lighting module disclosed herein.

U.S. Pat. No. 6,637,921, titled "Replaceable LED bulb with interchangeable lens optic", issued to Coushaine, and assigned to Osram Sylvania Inc. of Danvers, Mass., discloses a reflective optic that can receive light from an LED, emitted perpendicular to a circuit board, and reflect it in a number of directions, all roughly parallel to the circuit board. The optic disclosed by '921 may have the shape of an inverted cone, with the point of the cone facing the LED chip. The cone may be continuous, or may alternatively have discrete facets that approximate the shape of a cone. The reflective optic may be used with a single LED chip, or multiple LED chips arranged around the point of the cone. The reflective optic disclosed by '921 may be used with the LED-based lighting module disclosed herein, and may be disposed in the optical path between the LED chip and the reflector that directs the LED light towards a viewer.

BRIEF SUMMARY OF THE INVENTION

An embodiment is an automotive rear combination lamp (10), comprising: a housing (21) having a longitudinal axis; a generally planar ledge (31, 131) longitudinally adjacent to the housing (21) and generally parallel to the longitudinal axis of the housing (21), the ledge (31, 131) comprising a plurality of layers, the plurality comprising: a thermally conductive layer (43, 143) in thermal contact with the housing (21); and a printed circuit board (41) generally parallel to the thermally conductive layer (43, 143); a plurality of light emitting diodes (44, 144) disposed on the printed circuit board (41), the diodes (44, 144) being capable of being electrically powered by the printed circuit board (41), the diodes (44, 144) being capable of generating heat that is dissipated by the thermally conductive layer (43, 143) or by thermally conductive board (41), the diodes (44, 144) being capable of generating light that propagates away from the printed circuit board (41); and a concave reflector (13) having a focus, the concave reflector (13) having an aperture at its vertex for receiving the housing (21), the ledge (31, 131) and the light emitting diodes (44, 144). When the housing (21), the ledge (31, 131) and the light emitting diodes (44, 144) are fully inserted into the aperture in the concave reflector (13), the light emitting diodes (44, 144) are located at the focus of the concave reflector (13). When the housing (21), the ledge (31, 131) and the light emitting diodes (44, 144) are fully inserted into the aperture in the concave reflector (13), light (12) emitted from the plurality of light emitting diodes (44, 144) diverges away from the printed circuit board (41), reflects off the concave reflector (13) to form a collimated beam (14), and exits the lamp (10) largely parallel to the longitudinal axis of the housing (21).

Another embodiment is an automotive rear combination lamp (10), comprising: a concave reflector (13) for receiving diverging light (12) from a plurality of light emitting diodes (44, 144), and for reflecting a collimated beam (14) in a beam exiting direction; a largely planar structure (31, 131) for mechanically supporting the light emitting diodes (44, 144), for electrically powering the light emitting diodes (44, 144), and for removing heat from the light emitting diodes (44, 144), the largely planar structure (31, 131) comprising: a printed circuit board (41); and a thermally conductive layer (43, 143) parallel to and adjacent to the printed circuit board (41); and a housing (21) for mechanically supporting the largely planar structure (31, 131), the housing (21) being in thermal contact with the thermally conductive layer (43, 143). The largely planar structure (31, 131) is insertable in the beam exiting direction through an aperture in the concave reflector (13) as a replaceable module. When the largely planar structure (31, 131) is fully inserted into the aperture in the concave reflector (13), the plurality of light emitting diodes (44, 144) are located at a focus of the concave reflector (13). When the largely planar structure (31, 131) is fully inserted into the aperture in the concave reflector (13), the housing (21) remains largely outside the concave reflector (13).

DETAILED DESCRIPTION OF THE INVENTION

Figure 1:
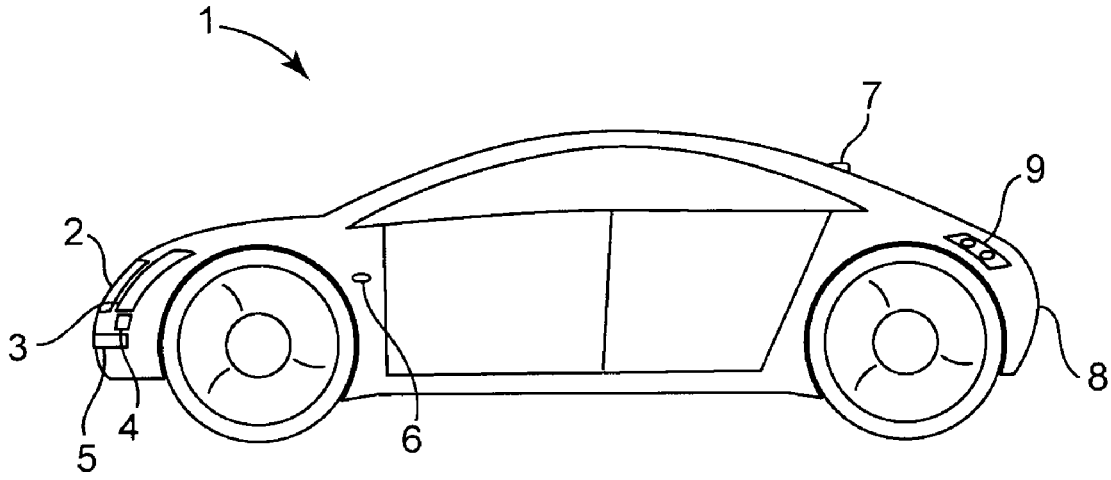
Fig. 1 PRIOR ART
FIG. 1 is a schematic drawing of the exemplary external lighting of an automobile.

The light emitting diode (LED) module disclosed herein may be used for exterior vehicle lighting. The LED module may be installed in a light set socket from the back and be replaceable, in a manner similar to that used with conventional incandescent bulbs. The LED module may also be installed and sealed in the reflector housing if a replaceable module is not necessarily needed. The LED module may include optical elements suitable to distribute the light to a reflector that receives light from the LED chip(s) and directs the reflected light toward a viewer. This is disclosed more fully in the detailed description below.

For typical, known rear combination lamps that use light emitting diodes as their light sources, there have been numerous ways of ensuring that the output light exits the device with the proper orientation. For instance, the first generation system commercially available with the name JOULE used light emitting diodes mounted at a particular angle. The assembly process for this first generation system was undesirably complicated, and included a difficult connection between the LEDs and control circuit boards. For the second generation JOULE system, this mounting scheme for the light emitting diodes was replaced with a light guide and a small reflector that image the emission point of the LED onto the focal point of the rear combination lamp reflector. The light guide is typically a transparent tube of glass or plastic, with smooth sides that ensure that a beam transmitted along the light guide experiences total internal reflection at each reflection off the sides. The light guide, while an improvement over the first generation product, is still an extra component in the system, thereby increasing the cost of the system, and is still lossy, losing a fraction of light at the entering and exiting interfaces of the light guide. Additional LEDs were required to overcome the losses introduced by the light pipe and associated optics. A system using side-emitting light emitting diodes has also been tried, but also had either assembly difficulties or a low optical efficiency.

In general, all of the previous rear combination lamps exhibit some sort of deficiency, whether it is a difficulty in assembly, a low optical efficiency, or an incompatibility with current housings for rear combination lamps.

The present invention overcomes these deficiencies and may provide one or more of the following advantages:

First, the light emitting diode module is fully integrated, thereby reducing the number of components and simplifying the assembly of the module. Furthermore, because the light emitting diodes and electronics are on the same board, there is no need for an additional interconnection between them.

Second, the light emitting diode module is backwards-compatible, and has optical and mechanical characteristics that match, or are readily adaptable to, those of current rear combination lamp housings. In this case, the socket may be used as a heat sink. If additional heat sinking is needed, thermal pins or fins may be added on the back of the printed circuit board.

Third, the loss of the LED module is reduced, thereby increasing the brightness of the module and/or reducing the amount of electrical power required to operate the module. A light pipe or any additional optics is not needed.

We provide a brief summary of the disclosure in the following ten paragraphs, followed by a detailed description of the optical path in the rear combination lamp, followed by a detailed description of the mechanical aspects of the rear combination lamp.

A rear-loading LED module for a rear combination lamp is disclosed. One or more LEDs are mounted on a printed circuit board that mechanically holds them at the focus of a faceted, parabolic reflector. Light emitted from the LEDs is collimated by the reflector, and the reflected collimated light is directed in a generally longitudinal direction out of the rear combination lamp, toward the viewer.

The LED module itself is generally longitudinally oriented, and is insertable longitudinally into the interior of the reflector from a hole at the vertex of the reflector. The printed circuit board, an optional thermal pad adjacent to the printed circuit board, and a thermally conductive layer adjacent to the optional thermal pad are all generally planar layers, are all generally parallel to each other, and may optionally all have the same footprint. Together, the printed circuit board, the thermal pad and the thermally conductive layer may all form a generally planar ledge.

In some applications, the planar ledge may be oriented generally vertically and in the longitudinal direction. The LEDs mounted on the printed circuit board may emit light generally perpendicular to the ledge. The diverging light from the LEDs may propagate laterally, toward the leftmost and/or rightmost edges of the lamp. The reflector operates off-axis and bends the optical axis by roughly 90 degrees, so that the reflected light propagates longitudinally, toward the front edge of the lamp.

In other applications, the planar ledge may be oriented generally horizontally, and in the longitudinal direction. The LEDs mounted on the printed circuit board may emit light generally perpendicular to the ledge. The diverging light from the LEDs may propagate vertically, toward the top and/or bottom edges of the lamp. In these applications, the lamp may include one or more intermediate reflectors that divert the vertically propagating light from the LEDs. Light reflected from the one or more intermediate reflectors propagates generally horizontally, toward the collimating reflector. The collimating reflector operates off-axis and bends the optical axis by roughly 90 degrees, so that the reflected light propagates longitudinally, toward the front edge of the lamp.

The circuit board may include one or more connector pins, which extend generally off the end of the circuit board, parallel to the circuit board, and provide electrical power and/or monitoring to and/or from the circuit board. The connector pins may include a plastic connector attached to the pins.

The light exiting the LEDs is divergent, with a particular angular pattern characterized by the LEDs themselves. Each LED emits a beam that travels away from the center of the vehicle, generally parallel to the ground. The fixture includes a curved reflector that collimates the light from the LEDs, and reflects the collimated light from the rear of the vehicle, roughly parallel to the ground.

The shape of the reflector may be a half-paraboloid, with the LEDs being located at or near the focus of the paraboloid. If there are two or more LEDs, the light from each LED may be collimated and reflected by the reflector in the fixture, but light from the two LEDs may emerge at slightly different angles, given by the lateral separation of the LEDs divided by the focal length of the parabolic reflector. In general, the emission pattern from the fixture should conform to a particular legal requirement that may dictate the angular profile of the emergent light in two dimensions.

The reflector in the fixture may be faceted, so that the light emerging from the fixture may satisfy a particular predetermined angular requirement. Such faceting of the reflector is known, and is described in greater detail below.

Simulations were performed, prototypes were built, and measurements of power (or flux, in lumens) were taken and were found to agree with the simulations.

In some embodiments, the module and/or socket parts may act as a heat sink. Either or both may be made out of aluminum, or other suitable heat-conducting material, to move heat away from the fixture.

Having provided a brief summary of the disclosure, we next provide a discussion of the optical path in the rear combination lamp, followed by a more detailed discussion of the mechanical implementation of the optical components.

Figure 2:
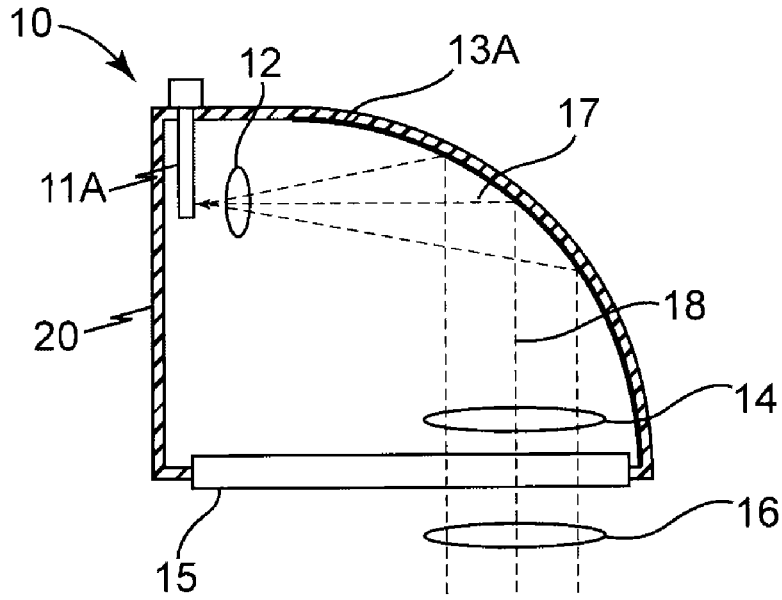
FIG. 2 is a cross-sectional schematic drawing of a simplified optical path in a rear combination lamp, having a single LED and an un-faceted reflector.

FIG. 2 is a cross-sectional schematic drawing of a simplified optical path in a rear combination lamp 10. An LED module 11A emits a diverging beam 12 laterally, toward the side of the rear combination lamp 10. The diverging beam has a peak brightness along a particular direction, denoted here as an optical axis 17.

The diverging beam 12 may be characterized by a particular angular distribution or an angular width, which describes how quickly the beam's brightness decreases, as a function of angle. For instance, the diverging beam may have a characteristic full-width-at-half-maximum (FWHM) for its intensity or brightness, or a half-width-at-1/e^2-in-intensity, or any other suitable angular width. The characteristic angular widths of the diverging beam may be the same or may be different along the x- and y-directions, where the optical axis may be considered to be the z-direction. The size of the diverging beam grows as it propagates along the optical axis 17, roughly in proportion to the distance from the LED module 11A.

In this simplified optical path of FIG. 2, there is only a single LED in the LED module 11A. In practice, there may be more than one LED in the module; this case is treated explicitly following the discussion of the simplified system in FIG. 2.

The diverging beam 12 strikes a concave reflector 13A, which collimates the beam and reflects a collimated beam 14 longitudinally, toward the front of the rear combination lamp 10.

The reflector 13A may have the shape of a paraboloid, which is parabolic in a cross-section that includes its vertex. It is known that parabolic reflectors form a virtually aberration-free collimated beam from a light source placed at the focus of the paraboloid. Longitudinal shifting of the source away from the focus may produce defocus, or deviation away from collimation, or, equivalently, deviation of the light flux away from parallelism. Lateral shifting of the source away from the focus may produce a pointing error of the reflected collimated beam. In other words, for a laterally shifted source, the reflected beam is still collimated, but the reflected beam may angularly deviate from the un-shifted case. In general, the value of such an angular shift, in radians, equals the lateral shift of the source, divided by the focal length of the parabolic reflector. For large enough lateral shifts away from the focus, the reflected beam may also exhibit monochromatic wavefront aberrations, such as coma.

For an old-style reflector that used incandescent bulbs, the bulb was typically placed at the focus of a parabolic reflector, symmetrically, from the back of the reflector. The reflector typically surrounded the bulb, with an opening toward the front of the fixture. Because an incandescent bulb radiated light into all directions (except toward the socket), it was useful to surround the bulb azimuthally, so that as much radiated light as possible was directed into the collimated beam emerging from the parabolic reflector.

In contrast, for parabolic reflectors that use LEDs as their light sources, it is not necessary to use the full, 360-degree azimuthally-complete paraboloid to capture all the light radiated from the source. Because LEDs radiate into a relatively small solid-angle cone, compared with incandescent bulbs, one need only use a portion of the paraboloid that the sufficiently captures the full spatial extent of the beam at the reflector. As a result, the reflector 13A may be a fraction of a paraboloid, such as a half-paraboloid, or other suitable paraboloid portion. Note that a half-paraboloid may be visualized by bisecting the full paraboloid by a plane that extends through its vertex and its focus. Optically, such a fraction of a paraboloid works sufficiently well to capture the diverging light from the source, and uses less volume and less material than a full paraboloid would.

In FIG. 2, one may consider the optical axis to bend at the reflector, so that for the collimated beam, the optical axis 18 may be oriented largely longitudinally, toward the front of the rear combination lamp 10. In some applications, the optical axis 17, 18 may bend by 90 degrees at the reflector. In other applications, it may bend by slightly more than 90 degrees or slightly less than 90 degrees. For all of these cases, we may refer to the diverging beam 12 as having a "largely" lateral orientation, and collimated beam 14 as having a "largely" longitudinal orientation.

The collimated beam 14 may be commonly referred to in the literature as "parallel light flux". These terms are interchangeable, and may be considered equivalent as used in this application.

After passing through a "clear cover" or "lens cover" 15, the collimated beam 14 remains collimated 16, and exits the rear combination lamp 10 at the rear of the automobile, toward the viewer. The clear cover 15 may have an optional spectral effect, such as filtering one or more wavelengths or wavelength bands from the transmitted light, but typically does not scatter the beam, as a diffuser would.

The LED module 11A, the reflector 13A, and the clear cover 15 may all be held mechanically by a housing 20. Such a housing 20 may be desirable in that it can be manufactured inexpensively, and may be molded or stamped to include the surface profile of the reflector 13.

The mechanical aspects of the rear combination lamp 10 are discussed in much greater detail below, following the current description of the optical path.

The simplified rear combination lamp 10 of FIG. 2 may require some modifications before it can meet the legal requirements for a rear combination lamp; recall that those requirements were defined for incandescent lamps, and that new LED-based lamps may be designed to have their outputs "look like" those from incandescent-style fixtures, in order to meet the old requirements.

For instance, the rear combination lamp may require more light output power than is possible or convenient from a single LED. Such a multi-LED is shown schematically, in simplified form, in FIG. 3.

Compared with the rear combination lamp 10 of FIG. 2, the only different component is a multi-LED module 11B, which includes three LEDs. In this simplified schematic, the LEDs all emit light in roughly the same direction, to within typical manufacturing, assembly and/or alignment tolerances. In other applications, one or more LEDs may point in different directions.

The light from each of the three LED sources on the multi-LED module 11B is traced throughout the rear combination lamp 10, so there are three sets of dashed lines to represent the beam. The effect of having multiple, spatially separated sources, in such a system is that there may be some small angular deviation of some rays in beam 16 away from the optical axis 18. Such angular deviation is typically small, such as on the order of only a few degrees, and the output beam 16 is still considered to be collimated.

From an optics perspective, it is desirable to have the LEDs as close together as possible. However, from a thermal perspective, it is desirable to have the LEDs as far apart as possible, so that the heat generated by each LED may be dissipated efficiently. In practice, the LEDs may be spaced apart on a printed circuit board by up to a few mm or more. The thermal aspects of the rear combination lamp 10 are discussed more fully below, following the current description of the optical path.

Figure 3:
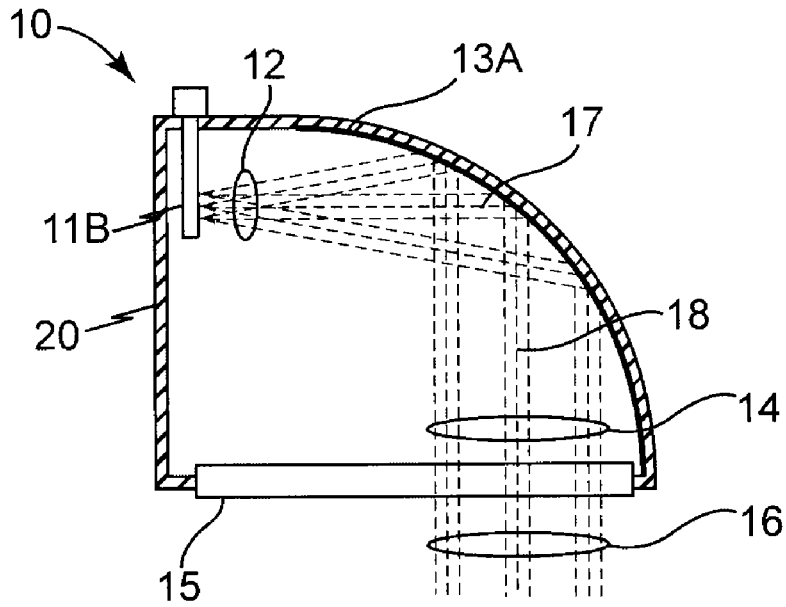
FIG. 3 is a cross-sectional schematic drawing of a simplified optical path in a rear combination lamp, having multiple LEDs and an un-faceted reflector.

The simplified rear combination lamp 10 of FIG. 3 may have sufficient output optical power to meet the appropriate legal requirements, but it may not have a suitable angular distribution of light in the output beam 16. In other words, the output beam 16 may be too strongly directional, so that if a viewer's line of sight is outside the relatively narrow output beam 16, the lamp may not appear bright enough.

This may be understood more clearly by examining the lamp output angular requirements and their evolution from the output of incandescent bulbs. Light emerging from an old-style reflector fixture includes two portions that are superimposed: (1) Light that travels from the bulb directly out the clear cover, and (2) Light from the bulb that reflects off the parabolic reflector. Portion (1) is diverging, while portion (2) is generally collimated. The combination of these two portions, in the space away from the automobile, has an angular dependence, with the intensity being greater when the viewer's line of sight is within the collimated beam from portion (2). However, the angular dependence is dampened by the relative weak angular dependence of portion (1). As a result, typical cutoff values for angular output evolved to be about +/−10 degrees in the vertical direction and about +/−20 degrees laterally, so that the light from the lamp could be adequately seen if a viewer's line of sight is "within" the angular cutoff, but not necessarily need to be seen if the viewer's line of sight is outside the angular cutoff.

As a result, the output beam 16 from the simplified rear combination lamp 10 of FIG. 3 may be too narrow to meet the angular requirements of about +/−10 degrees vertically and about +/−20 degrees laterally, since its angular extent may be only +/− a few degrees at most. A known element that was developed for angularly broadening a beam without significantly altering its collimation is shown in FIG. 4, and may be referred to as a "faceted" reflector.

Figure 4:
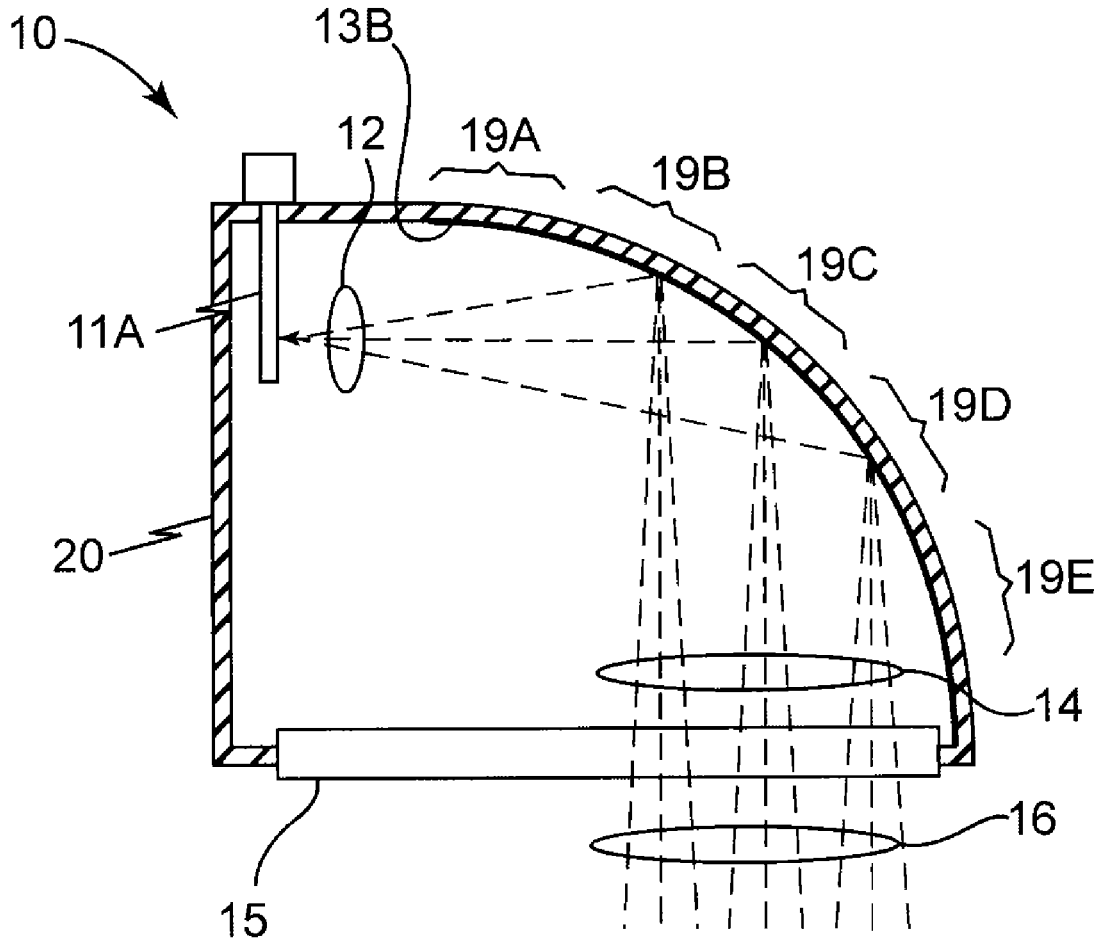
FIG. 4 is a cross-sectional schematic drawing of a simplified optical path in a rear combination lamp, having a single LED and a faceted reflector.

Compared with the schematic drawing of FIG. 2 of the simplified rear combination lamp 10, the only difference in FIG. 4 is the replacement of the simple parabolic reflector 13A with faceted parabolic reflector 13B. In general, faceted reflectors are known in the industry, and have been disclosed in the patent literature as far back as 1972 or earlier. Three such known faceted reflectors are summarized below. It will be appreciated that in addition to the three examples summarized below, any suitable faceted reflector design may be used. For the exemplary drawing in FIG. 4, each facet 19A, 19B, 19C, 19D and 19E directs light into generally the same predetermined angular range, with the full lamp output having generally the same angular range as each of the facets. In alternate embodiments, each facet may direct light into its own individual predetermined angular range, with the full lamp output including the angular contributions from all the facets.

One of the relatively early faceted reflector designs is disclosed in U.S. Pat. No. 3,700,883, titled "Faceted reflector for lighting unit", issued on Oct. 24, 1972 to Donohue et al., and incorporated by reference in its entirety herein. Donohue discloses a prescription for making the reflector, including setting the number, size, curvature and location of each facet to produce undistorted reflected images of the light source, the cumulative effective of which produces the desired illumination distribution within prescribed limits. Because true parabolic cylindrical surfaces were difficult to manufacture in 1972, Donohue includes mathematical approximations to allow for the use of circular cylindrical surfaces instead.

Another faceted reflector design is disclosed in U.S. Pat. No. 4,704,661, titled "Faceted reflector for headlamps", issued on Nov. 3, 1987 to Kosmatka, and incorporated by reference in its entirety herein. In contrast with the earlier Donohue patent that used right cylindrical surfaces, the Kosmatka patent uses right parabolic cylindrical surfaces and simple rotated parabolic surfaces.

A third known faceted reflector design is disclosed in U.S. Pat. No. 5,406,464, titled "Reflector for vehicular headlamp", issued to Saito on Apr. 11, 1995, and incorporated by reference in its entirety herein. Saito discloses a reflector that has several reflecting areas, with each reflecting area including several segments. Each segment has a basic curved surface (hyperbolic paraboloid, elliptic paraboloid, or paraboloid-of-revolution), and is laid out on a paraboloid-of-revolution reference surface having locally different focal distances.

As used in the rear combination lamp 10 of FIG. 4, the faceted reflector 13B receives the diverging beam 12 from the LED module 11A, collimates the beam and angularly diverts portions of the beam, and directs the collimated and angularly diverted beam 14 to the clear cover 15, through which light exits the lamp 10.

We summarize the optical path in the lamp 10 of FIG. 4 before discussing the mechanical package for the lamp. An LED module 11B is placed at or near the focus of a faceted parabolic reflector 13B. The LED module 11B is oriented to direct its diverging light output largely laterally. The diverging beam 12 from the LED module 11B strikes the faceted parabolic reflector, 13B so that the optical axis 17 has about a 45 degree angle of incidence, and the reflected optical axis 18 leaves the reflector at about a 45 degree angle of exitance. The incident optical axis 17 is largely horizontal and lateral, and the reflected optical axis 18 is largely longitudinal. The parabolic reflector 13B collimates the beam and reflects a collimated beam, and the facets produce a particular angular distribution to the reflected collimated beam 14. The reflected collimated beam 14 passes through the clear cover 15 and becomes the exiting beam 16 that propagates toward a viewer.

Having summarized the optical path, we now discuss the mechanical package of the rear combination lamp 10, which holds the optical components in place, delivers electrical power to the LEDs, and dissipates heat produced by the LEDs.

Figure 5:
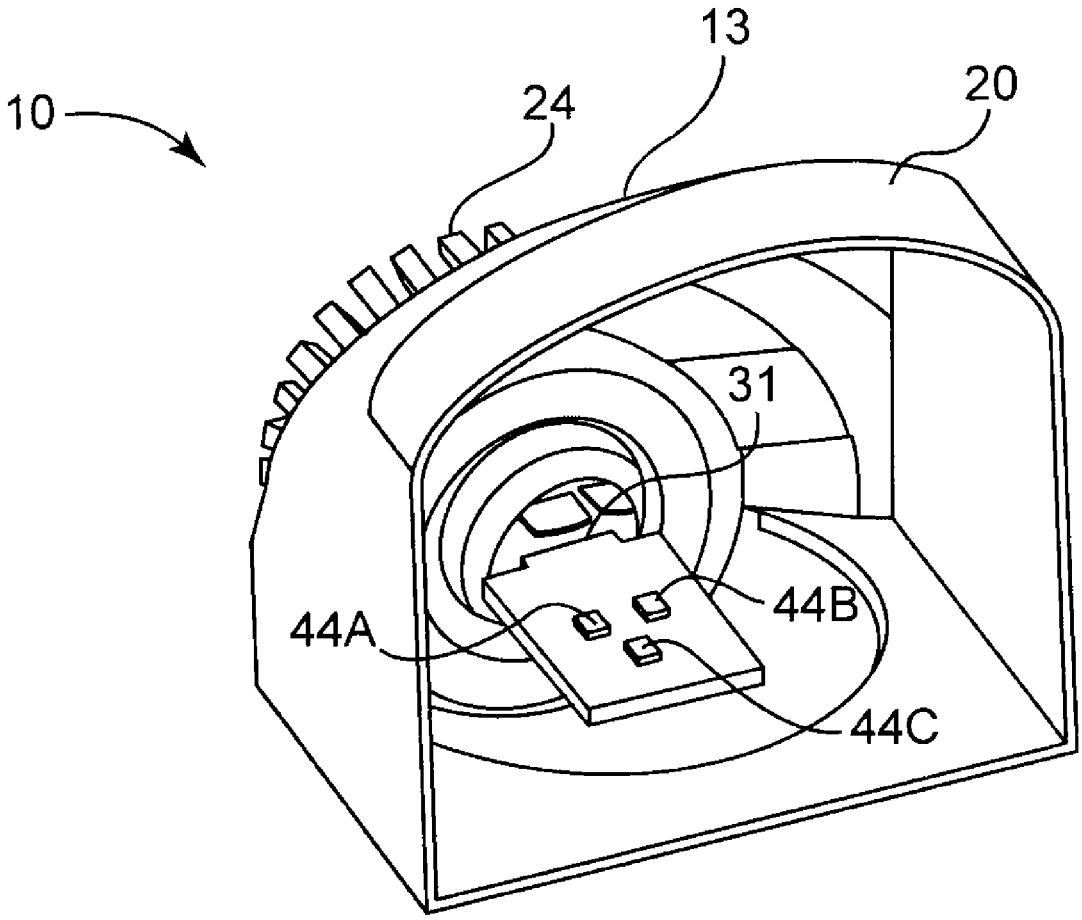
FIG. 5 is an assembled view schematic drawing of an exemplary mechanical layout of a rear combination lamp.
Figure 6:
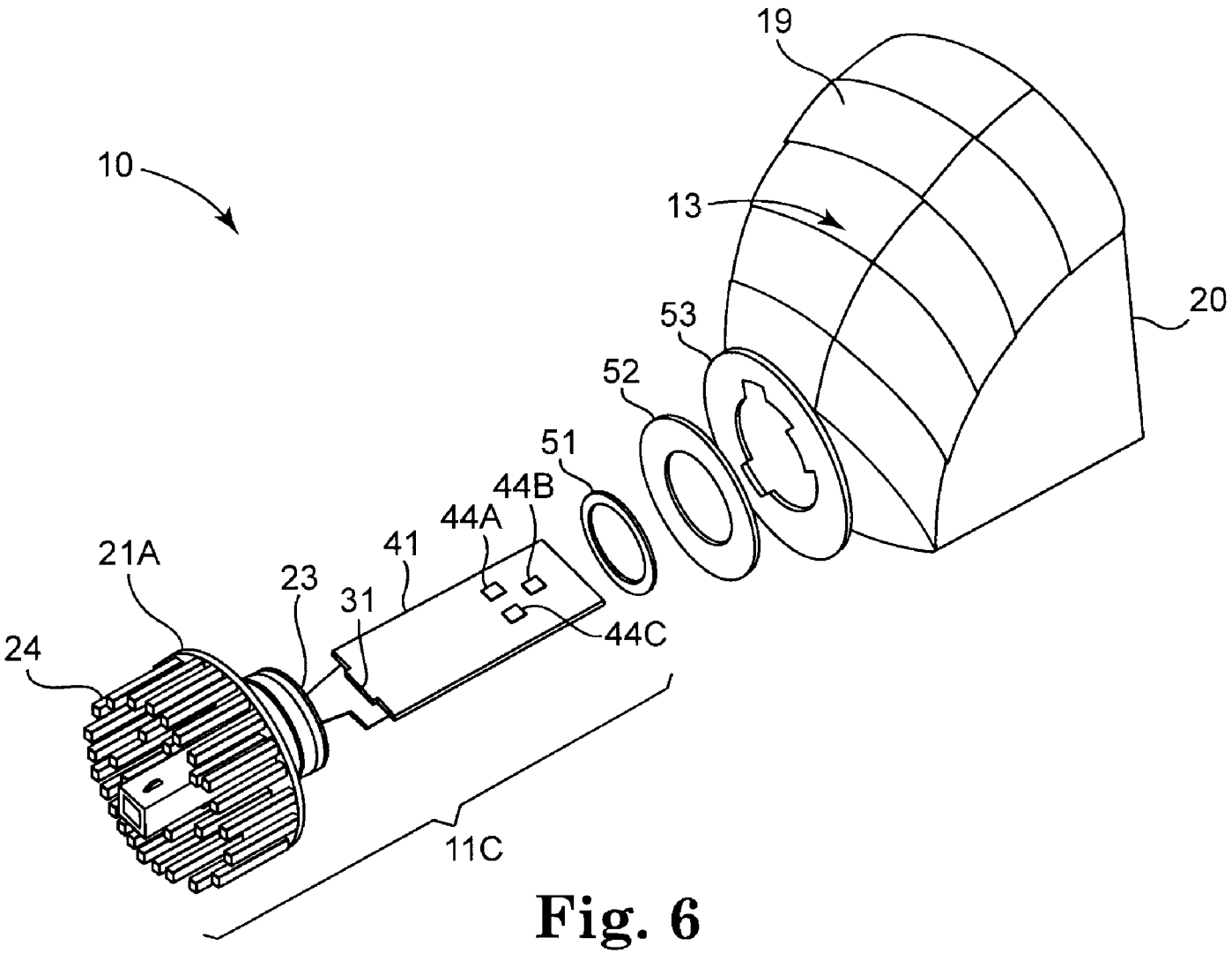
FIG. 6 is an exploded view schematic drawing of the exemplary rear combination lamp of FIG. 5.

FIGS. 5 and 6 are assembled and exploded view schematic drawings of an exemplary mechanical layout of a rear combination lamp 10.

An LED module 11C is inserted from the rear of the lamp, longitudinally, in a manner similar to that of conventional incandescent lamps. Light from the LEDs is emitted laterally from the LED module 11C, horizontally, generally perpendicular to the ledge surface of the printed circuit board. The inner surface 13 of the housing 20 is a faceted, concave reflector that collimates the light and redirects it longitudinally, through a clear cover (not shown in FIGS. 5 and 6), out of the lamp. The facets 19 on the reflector angularly divert portions of the reflected, collimated light, to satisfy a predetermined angular requirement on the light emitted from the lamp.

The housing 20 may be a single part that includes the curved and faceted surface of the reflector 13, which may optionally include additional reflective coatings on it, as well as adjacent flat surfaces for mounting and interfacing with additional components. The housing 20 includes a flat surface that is perpendicular to the cylindrical or longitudinal axis of the heat sink 21, which mechanically supports the adapter 53 and the LED module 11 when assembled. Note that the adapter feature 53 may also be a built-in feature on the housing 20. The housing 20 may be made from any suitable material, such as metal, plastic, or any other suitable material or combination of materials.

The lamp 10 may also include a clear cover on its front face, which is not shown in the figures. Such a clear cover may optionally include one or more sealing features, to protect the other components from the elements.

The LED module 11C includes a heat sink 21A, and a generally planar ledge 31 protruding longitudinally from the heat sink 21A. The heat sink 21A may be made, in whole or in part, of a thermally conducting material, such as aluminum. The heat sink 21A may optionally include heat dissipating features, such as fins 24.

The ledge 31 may include one or more layers, the layers being generally parallel and optionally having the same footprint (or lateral extent) on the ledge 31. The structure of the ledge 31 is shown in greater detail in the text below and in the figures that follow. The one layer of the ledge 31 that is shown in FIGS. 5 and 6 is a printed circuit board 41. In some applications, the printed circuit board 41 may be thermally conductive, such as a metal core type printed circuit board or a printed circuit layer on top of an aluminum plate with an insulating layer on the top.

The printed circuit board 41 serves as a mechanical mount for one or more LEDs. In the example of FIGS. 5 and 6, there are three LEDs 44A, 44B and 44C mounted on the surface of the printed circuit board, although it will be understood that more or fewer than three LEDs may be used. Each of the LEDs emits diverging light perpendicular to the plane of the printed circuit board 41, and therefore, perpendicular to the ledge 31. In other applications, the LEDs may be mounted along one or more edges of the printed circuit board, and may emit diverging light off the edges of the printed circuit board, generally parallel to the printed circuit board and the ledge; these applications are shown and discussed in greater detail below.

The printed circuit board 41 also provides electrical power to the LEDs 44A, 44B and 44C. The power may be delivered from the electrical system of the automobile through a hole 23 in the heat sink via a connector (not shown) to the printed circuit board 41. Optionally, the printed circuit board 41 may provide monitoring of the LED current, temperature, impedance, or any other suitable quantity.

The LED module 11C, which includes the heat sink 21A and ledge 31, may be inserted longitudinally into a housing 20. The housing 20 has a concave reflector along one of its interior surfaces 13. The reflector has hole at its vertex, through which the LED module 11C may be inserted. The reflector also has a focus, so that when the LED module 11C is fully inserted into the housing 20, the LEDs 44A, 44B and 44C are located at the focus. Displacing the LEDs from the focus may lead to decollimation of the light that exits the lamp, so it is generally desirable to locate the LEDs as closely as is feasible to the focus of the reflector.

The lamp may include one ore more retaining rings, gaskets, or sealing rings 51 and 52. The lamp may also include a quarter turn adapter 53. The rings may protectively seal the circuitry and LEDs from the elements, and may optionally provide spacing and/or locating features that may help ensure that the LEDs are located properly when the LED module 11C is fully inserted. In some applications, the LED module 11C may be only partially inserted, then secured to the housing.

Note that when the LED module 11C is fully inserted into the housing, the ledge 31 is largely inside the housing 20, in the interior of the concave reflector, and the heat sink 21A is largely outside the housing 20. It will be understood that a small portion of the ledge 31 may extend outside the housing 20, such as for connection, thermal or mechanical stability purposes. Likewise, a small portion of the heat sink 21A may extend inside the housing 20, for similar reasons.

Note also that this particular LED module 11C is attached to the housing 20 so that the printed circuit board 41 is oriented largely vertically, to within typical manufacturing, assembly and alignment tolerances. The quarter turn features on the socket and the reflector can ensure the alignment of the LED to the reflector. In this orientation, light from the LEDs 44A, 44B and 44C is emitted horizontally and propagates directly to the parabolic reflector, with no intermediate optical components.

The LEDs 44A, 44B and 44C are mounted on one side of the printed circuit board 41, so that they all emit in generally the same direction, perpendicular to the plane of the circuit board. In general, it is typical to try and mount the LEDs so that their emissions are truly parallel, but in practice there may be some small variations in the LED pointing angles due to component, manufacturing and assembly tolerances. In general, these small LED pointing errors do not create problems for the lamp.

The circuit board 41 includes the electrical circuitry that drives the LEDs 44A, 44B and 44C. The circuitry may be formed in a known manner, using techniques that are commonly applied to printed circuit boards. The LED driver circuit design may be a known design, such as, for example, the design from the reference cited above, U.S. Pat. No. 7,042,165, titled "Driver circuit for LED vehicle lamp", issued to Madhani et al., and assigned to Osram Sylvania Inc. of Danvers, Mass., which is incorporated by reference herein in its entirety. Alternatively, any suitable LED driver circuit may be used.

Although three LEDs are shown in FIG. 5, any suitable number of LEDs may be used, including one, two, three, four, five, eight, or any other suitable value. In general, the placement of the LEDs on the circuit board is determined by a compromise between optimizing the optical performance, which tends to group the LEDs as closely as possible, and optimizing the heat dissipation, which tends to spread the LEDs as far apart as possible.

The shape, or "footprint", of the printed circuit board 41 may be chosen arbitrarily. In the exemplary design of FIGS. 5 and 6, the footprint is rectangular. In some applications, a circular printed circuit board may be convenient for mounting into other components that have general cylindrical symmetry. Alternatively, the printed circuit board may be square or rectangular in profile; a rectangular footprint may be conducive to reducing any wasted circuit board material during the manufacturing process. In general, any suitable shape may be used for the printed circuit board 41.

The electrical connections to and from the printed circuit board are made through one or more electrical connectors. Connectors such as these are convenient for quickly engaging or disengaging the circuit board. The connector may be a known connector, such as those disclosed in the following two references: U.S. Pat. No. 7,110,656, titled "LED bulb", issued to Coushaine et al., and assigned to Osram Sylvania Inc. of Danvers, Mass., discloses a complementary socket and electrical connector mechanical structure for LED-based lighting modules, and is incorporated by reference herein in its entirety. U.S. Pat. No. 7,075,224, titled "Light emitting diode bulb connector including tension receiver", issued to Coushaine et al., and assigned to Osram Sylvania Inc. of Danvers, Mass., discloses another complementary socket and electrical connector mechanical structure for LED-based lighting modules, and is incorporated by reference herein in its entirety. Alternatively, any suitable connector may be used.

Figure 7:
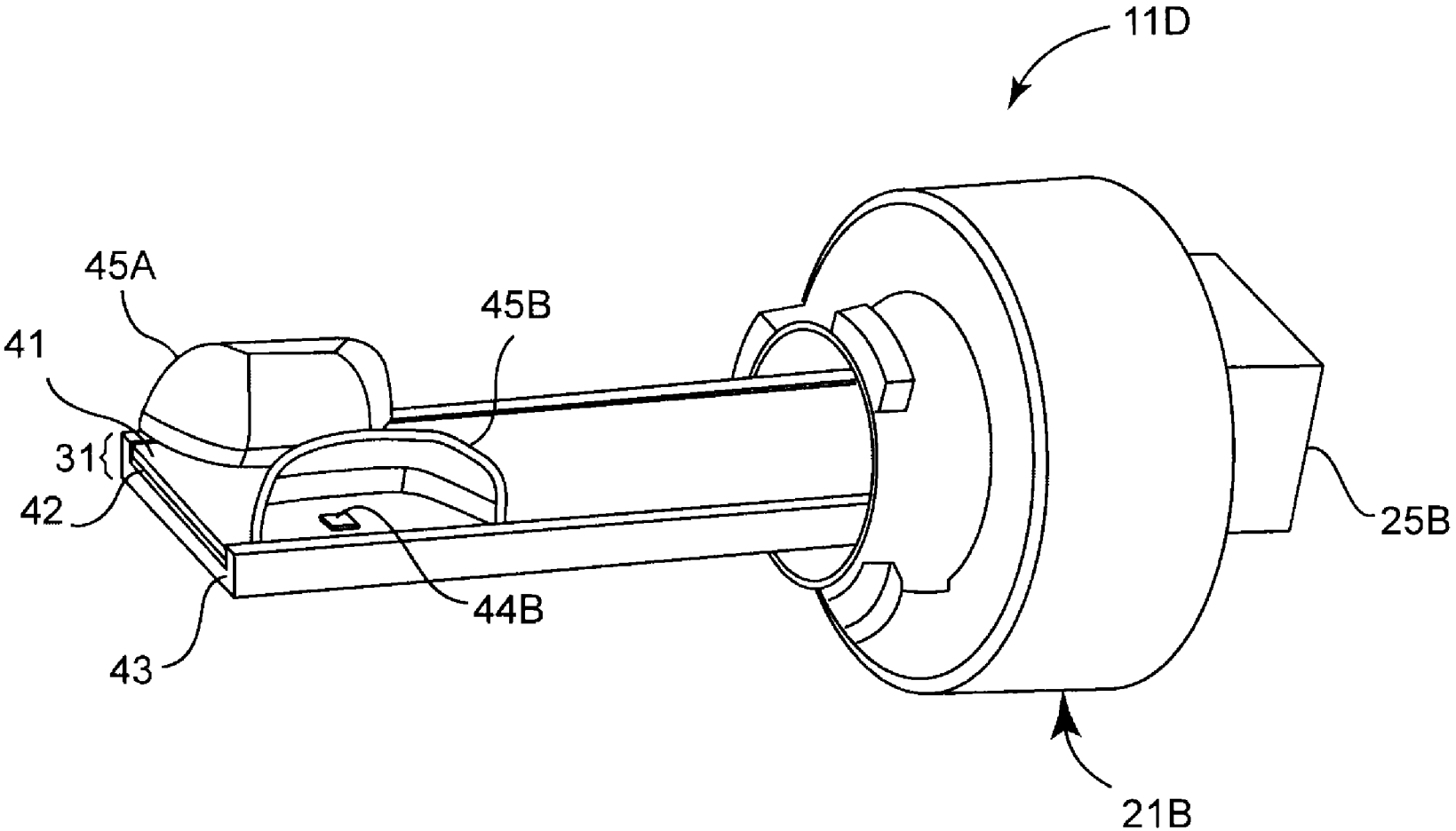
FIG. 7 is an assembled view schematic drawing of an exemplary mechanical layout of an LED module for a rear combination lamp.
Figure 8:
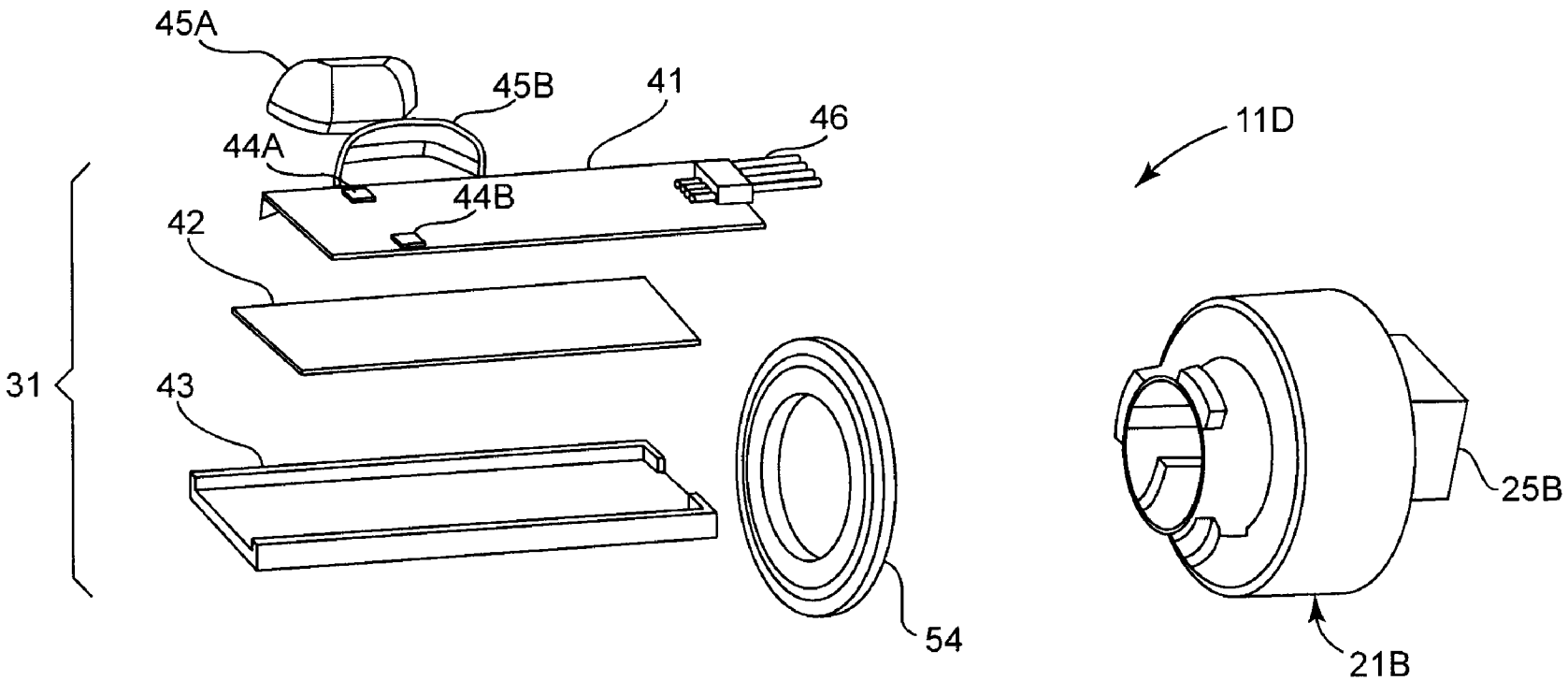
FIG. 8 is an exploded view schematic drawing of the LED module of FIG. 7.

FIGS. 7 and 8 are assembled and exploded view schematic drawings of another exemplary mechanical layout of an LED module 11D for a rear combination lamp. This LED module 11D, as well as subsequent LED modules discussed below, may be used with suitable housings and concave reflectors.

Compared with the LED module 11C from FIGS. 5 and 6, the most notable difference of the LED module 11D is that there are two intermediate reflectors 45A and 45B mounted on the printed circuit board 41 adjacent to the respective LEDs 44A and 44B.

These intermediate reflectors 45A and 45B receive part of the light emitted from the respective LEDs 44A and 45B, bend the light roughly 90 degrees, and redirect the light toward the parabolic reflector, which collects part of the light and directs it longitudinally out of the lamp. Because the intermediate reflectors introduce another bounce into the optical path, the LED module 11D may be mounted so that the ledge is largely horizontal. The light emitted from the LEDs is largely vertical, is largely horizontal and lateral towards to left/or right sides after reflection from the intermediate reflectors. In some cases, a full parabolic reflector instead of half parabolic reflector can be used to collimate the light; after collimation the light is largely longitudinal after reflection from the collimating parabolic reflector.

Any or all of the intermediate reflectors 45A and 45B may be flat, or may be curved in one or two dimensions. For instance, for a central portion of the exemplary reflectors 45A and 45B shown in FIG. 7 and 8, there is curvature in a cross-section that is parallel to the back of the automobile, but no curvature in a cross-section that is longitudinal.

For a flat intermediate reflector, the optical path may be bent so that the optical focus of the parabolic reflector follows the bent path, rather than remains at the same physical location in space. As such, an LED located at this optically-bent focus may be considered to be located "at" the focus of the reflector.

For a curved intermediate reflector, the curvature of the intermediate reflector may optionally be taken into account when designing the shape of the parabolic reflector. As such, the true shape of the parabolic reflector may deviate slightly from parabolic, so that the emergent beam may be truly collimated. This is a known feature from optical design, and has been used for many years in fields such as multi-mirror telescope design. For single-mirror telescopes, a parabolic objective mirror works sufficiently. For multi-mirror telescopes, in which the non-objective mirror includes some curvature, the curvature or surface profile of the objective mirror may be adjusted in the design phase to accommodate the curvature of the non-objective mirror. As such, the reflector in the rear combination lamp may be referred to as "parabolic", having a parabolic cross-section, or being a paraboloid, even though its true shape may be altered in the design phase to accommodate for any curvature in the intermediate reflectors.

FIG. 8 shows the layered structure of the generally planar ledge 31. The printed circuit board 41 includes two LEDs 44A and 44B and intermediate reflectors 45A and 45B for respective LEDs 44A and 44B. Adjacent to, and parallel to, the printed circuit board is an optional thermal pad 42. The thermal pad help ensure good thermal contact between the LEDs 44A and 44B and a thermally conductive layer 43, which is adjacent to, and parallel to, the thermal pad 42. Alternatively, the thermal pad 42 may be omitted, and the thermally conductive layer 43 may directly contact the printed circuit board 41. As a further alternative, there may be thermal putty or another suitable thermal conductor placed between the printed circuit board 41 and the thermally conductive layer 43. As a further alternative, the printed circuit board 41 itself can be made by thermal conductive material such as metal core printed circuit board or circuit traces printed on an aluminum plates/heat sinks with a very thin electrically insulating layer between the traces and the aluminum plates.

The printed circuit board 41 may also have a connector 46 that extends longitudinally off an edge of the printed circuit board 41. Such a connector 46 may include one or more pins that extend from the printer circuit board to the heat sink or housing 21B, and optionally through a hole in the heat sink or housing 21B to a mating connector (not shown) that attaches to the electrical system of the automobile. As such, the pins of the connector may be said to be "anti-parallel" to the longitudinal direction of the lamp, since they extend longitudinally away from the viewer, rather than toward the viewer.

The three layers that make up the ledge 31 may be attached to each other in any number of ways, including a snap fit, adhesive, screws, or any other suitable method.

In some applications, the thermally conductive layer 43 may be manufactured separately from the heat sink 21B, then attached to the heat sink. For these applications, the thermally conductive layer 43 and heat sink may be made from the same thermally conductive material, such as aluminum, or may alternatively be made from different thermally conductive materials. A potential advantage of manufacturing these two components separately is that assembling the ledge 31 may be simplified, since the ledge layers may be more easily accessible.

In other applications, the thermally conductive layer 43 may be an integral part of the heat sink 21B, and the two may be manufactured as a single part. A potential advantage of manufacturing these two components together is that the combination may be more rugged and durable than two components manufactured separately.

The heat sink or housing 21B may omit the fins 24 that are seen in the heat sink 21A design of FIGS. 5 and 6. In some applications, the entire housing may be made from a thermally conductive material. In other applications, part of the housing may be a relatively poor thermal conductor, such as plastic. A plastic portion may be desirable in some applications where it would be undesirable to have a hot part, such as a part that would have to be gripped by a user, or a part that may contact an element that might be damaged by heat.

The housing or heat sink 21B may have a structure that is suitable for an electrical connector or a mechanical mount. For instance the rectangular adapter 25B on the end of the heat sink 21B, away from the ledge 31, may be used to support one or both ends of an electrical connector. The rectangular adapter 25B may also include a longitudinal hole through the heat sink, for passing electrical connections through the heat sink to the connector 46.

There may also be a seal gasket 54 that provides a seal against the elements when the LED module 11D is installed in the housing.

For the designs shown in FIGS. 5 and 6, the LEDs 44 are mounted on the printed circuit board 41, typically away from the perimeter of the printed circuit board 41, and emit light generally perpendicular to the printed circuit board 41. There may be instances where it is desirable to have the emitted light propagate parallel to the printed circuit board 41. One option is to mount a reflector 45 near each LED 44 to redirect the emitted light, as shown in FIGS. 7 and 8. Another option is shown in FIG. 9.

Figure 9:
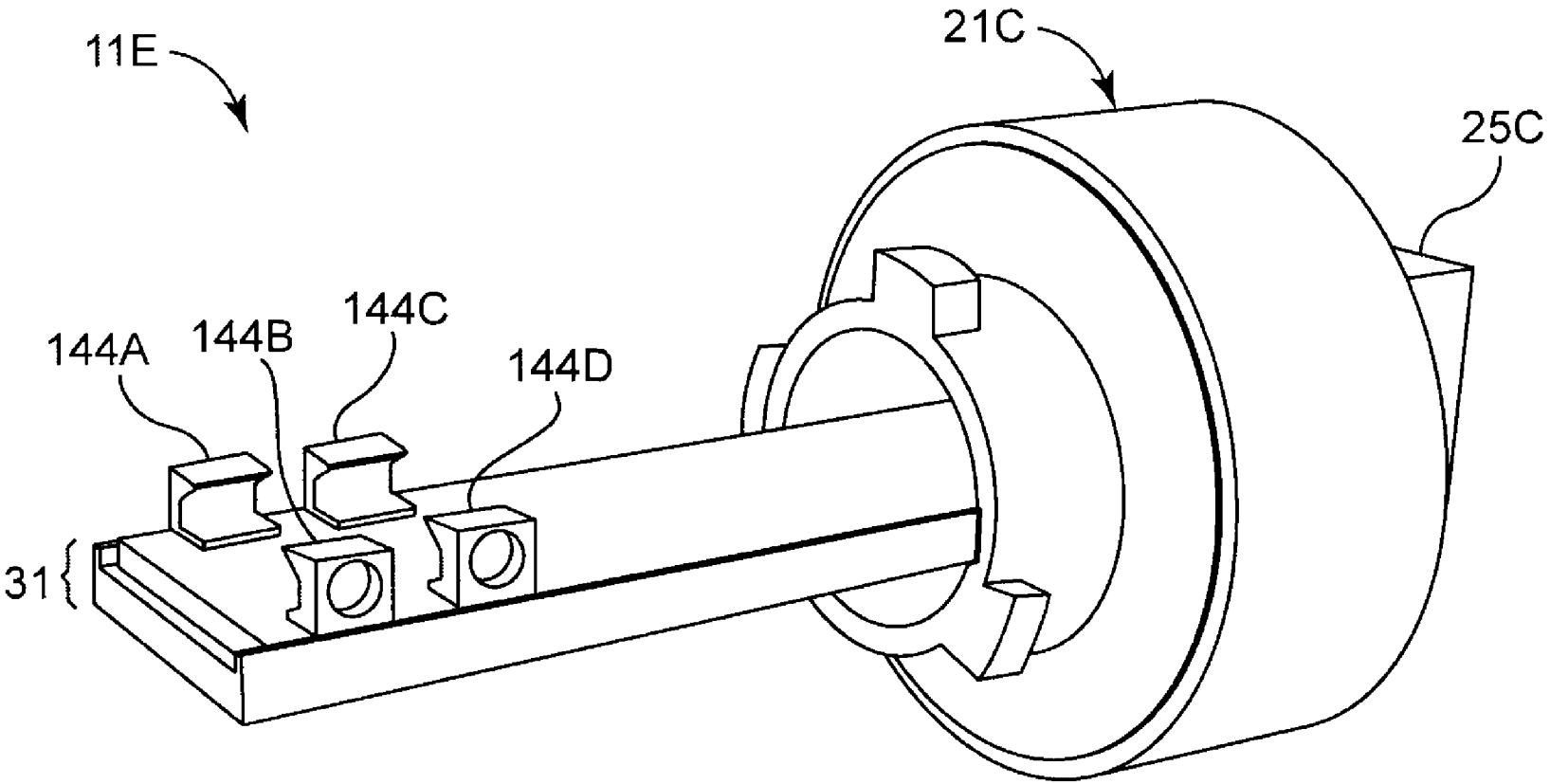
FIG. 9 is an assembled view schematic drawing of an exemplary mechanical layout of an LED module for a rear combination lamp.

FIG. 9 is an assembled view schematic drawing of an exemplary mechanical layout of an LED module 11E for a rear combination lamp. In this LED module 11E, the four LEDs 144A, 144B, 144C and 144D may be side-emitting and/or edge-mounted, at or near the perimeter of the printed circuit board, so that their diverging light output propagates away from the ledge 31, generally parallel to the circuit board and the ledge 31. For the geometry of FIG. 9, the light output propagates transversely, horizontally, toward the left and/or right sides of the automobile. This LED module 11E may be used with a full parabolic reflector, rather than a half-parabolic reflector.

The layered structure of the ledge 31 may be modified to accommodate the edge-mounted LEDs 144. This modified geometry is akin to forming a tray out of the thermally conductive layer, with the printed circuit board residing in the recessed interior of the tray, and the LEDs residing along the raised lip of the tray. For the purposes of this document, this modified "tray" structure may be considered to be adequately described by the layered structure described herein. Likewise, the footprint of each of the layers in the "tray" structure may be said to be identical.

The heat sink 21C and rectangular adapter 25C are similar in design and function to the heat sinks and adapters described above.

For the designs shown in FIGS. 5-9, the printed circuit board 41 is generally a poor thermal conductor. In order to dissipate heat generated by the LEDs 44, the ledge 31 uses thermally conductive layer, which is parallel to and in thermal contact with the printed circuit board 41. Another option for dissipating the heat is shown in FIG. 10.

Figure 10:
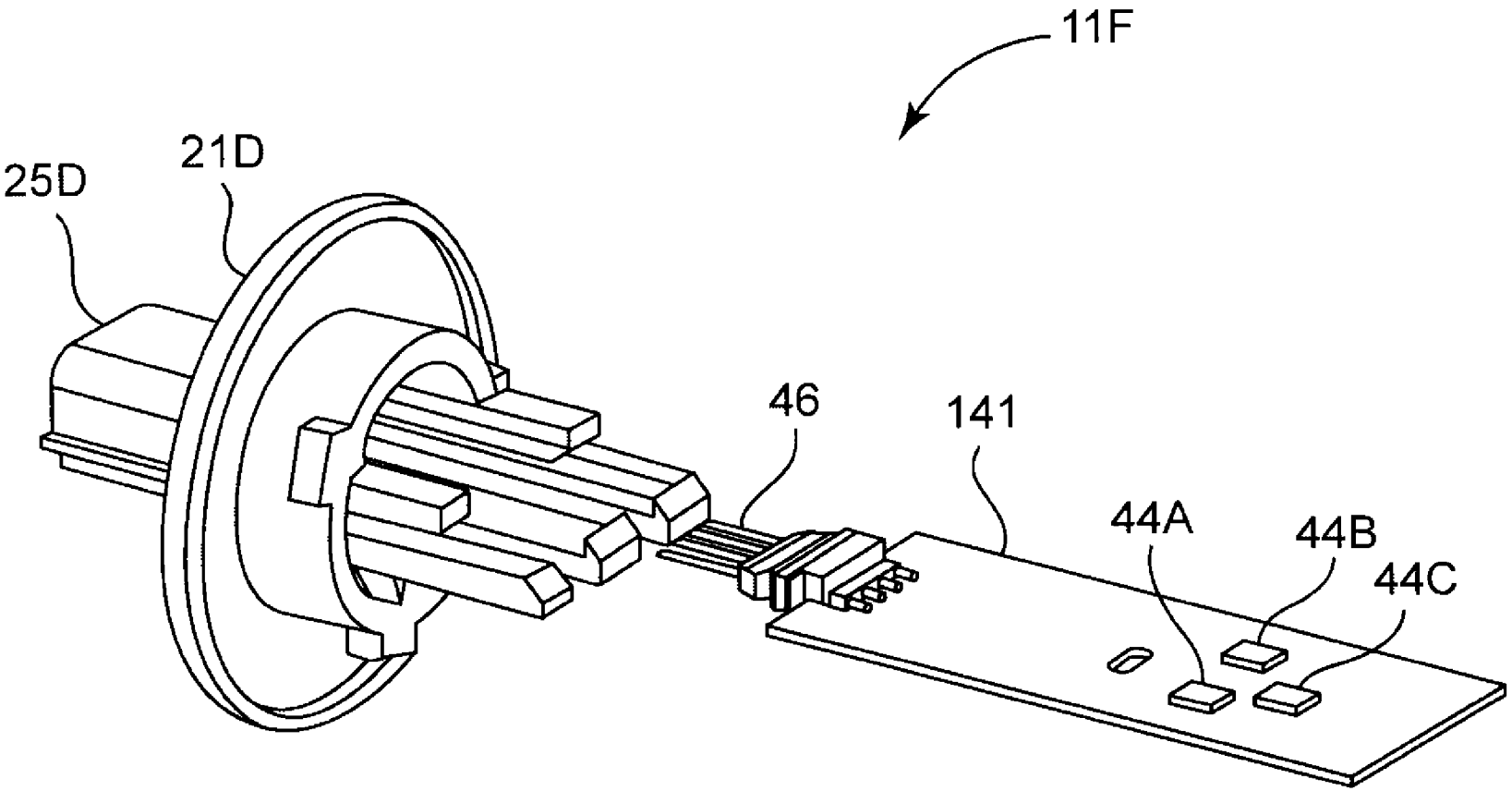
FIG. 10 is an assembled view schematic drawing of an exemplary mechanical layout of an LED module for a rear combination lamp.

FIG. 10 is an assembled view schematic drawing of an exemplary mechanical layout of an LED module 11F for a rear combination lamp. This particular LED module 11F uses a metal-core printed circuit board 141. The metal-core printed circuit board 141 is itself thermally conducting, and its use eliminates the need to use an additional thermally conducting layer or a thermal pad. Mechanically, this is a desirable design, due to the reduced number of components on the ledge. However, metal-core printed circuit boards may be expensive, may not be able to efficiently handle higher heat generated in some applications, and may cost more than the combined cost of a non-metal-core printed circuit board, a thermal pad and a thermally conductive layer.

The three LEDs 44A, 44B and 44C, the connector 46, the heat sink 21D and the adapter 25D may be similar in function to analogous elements described above.

Figure 11:
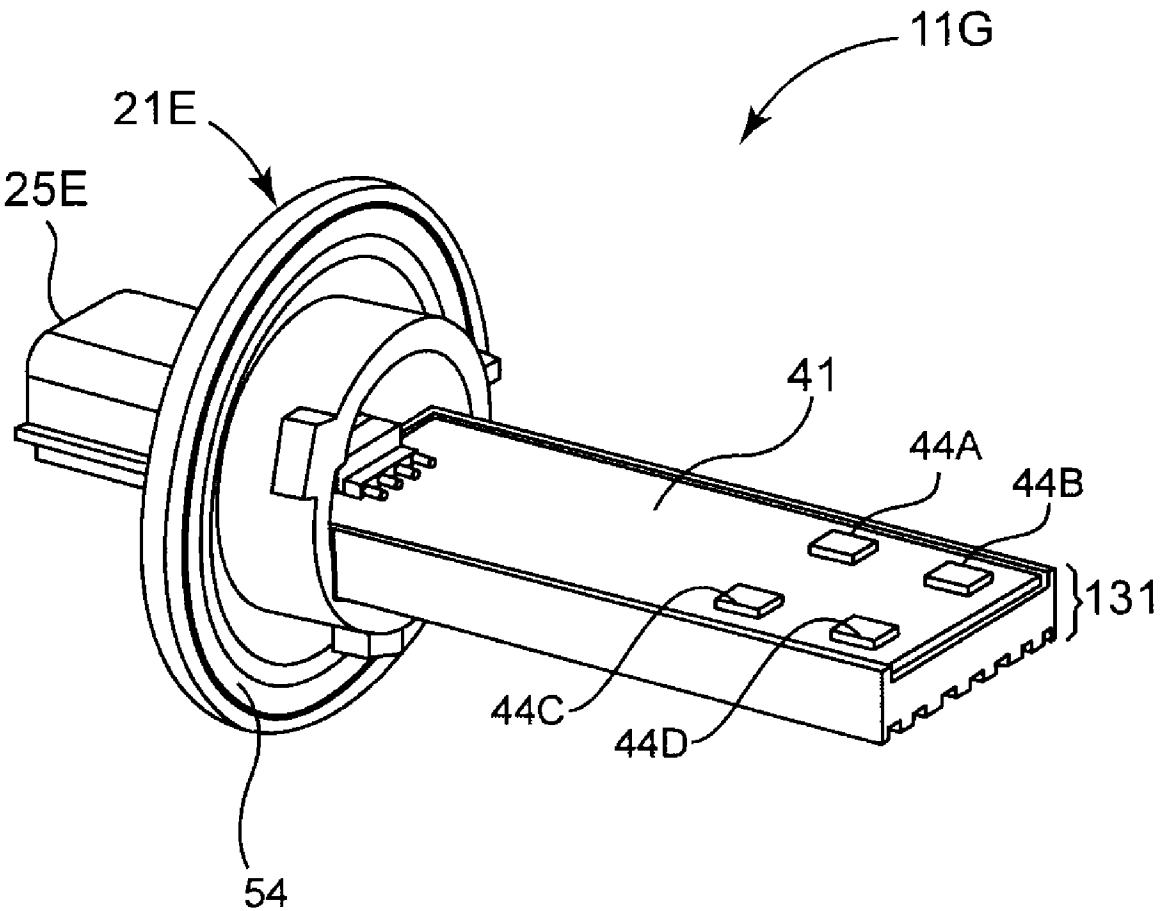
FIG. 11 is an assembled view schematic drawing of an exemplary mechanical layout of an LED module for a rear combination lamp.
Figure 12:
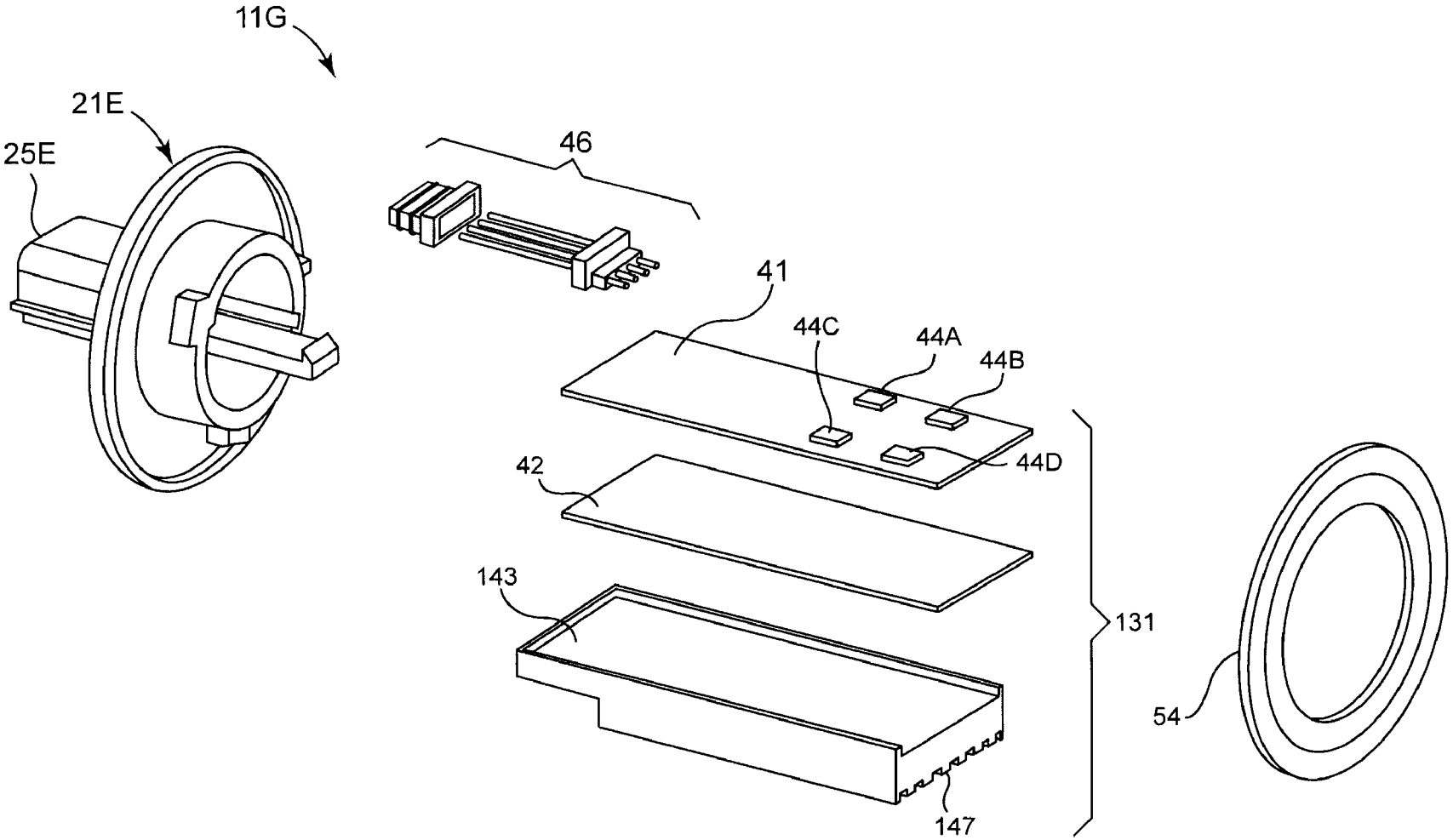
FIG. 12 is an exploded view schematic drawing of the exemplary LED module of FIG. 10.

For the designs shown in FIGS. 5-10, the ledge 31 is generally planar, with only the LEDs 44 and optional reflectors 45 extending significantly out of the general plane of the ledge 31. An alternative design for the ledge 131 is shown in FIGS. 11 and 12.

In particular, the ledge 131 of LED module 11G includes a thermally conductive layer 143 that has its own heat sink features 147, such as fins, on the side opposite the printed circuit board. For the purposes of this document, the heat sink features 147 on the thermally conductive layer 143 may be considered planar, and may be considered part of the generally planar layer structure of the ledge 131.

In addition, the thermally conductive layer 143 may include an optional lip that extends around the perimeter of the thermal pad 42 and printed circuit board 41. This lip may form a tray-like structure, so that the thermal pad 42 and printed circuit board may reside inside the "tray" of the thermally conductive layer 143. For the purposes of this document, the lip of the thermally conductive layer 143 may be ignored when describing the thermally conductive layer 143 as being parallel to and adjacent to another layer and having the same footprint as another layer.

The heat sink 21E, adapter 25E, printed circuit board 41, thermal pad 42, LEDs 44A, 44B 44C and 44D, connector 46 and seal gasket 54 may be similar in function to analogous elements described above.

Note that the ledges 31 and 131 are occasionally described herein as being rectangular or having a rectangular footprint. While a rectangular geometry may be desirable for reducing the amount of material that is wasted when forming the ledge components, it should be noted that other geometries may be suitable as well. For instance, the footprint may be round or elliptical, or may include notches, jagged shapes and features, or other irregularities. Furthermore, the footprint of one layer need not perfectly match the footprint of another layer. For instance, the printed circuit board may have notches or holes in it, while the thermal pad may lack these notches or holes.

The description of the invention and its applications as set forth herein is illustrative and is not intended to limit the scope of the invention. Variations and modifications of the embodiments disclosed herein are possible, and practical alternatives to and equivalents of the various elements of the embodiments would be understood to those of ordinary skill in the art upon study of this patent document. These and other variations and modifications of the embodiments disclosed herein may be made without departing from the scope and spirit of the invention.

We claim:

1. An automotive rear combination lamp (10), comprising:

a concave reflector (13) for receiving diverging light (12) from a plurality of light emitting diodes (44, 144), and for reflecting a collimated beam (14) in a beam exiting direction;

a largely planar structure (31, 131) for mechanically supporting the light emitting diodes (44, 144), for electrically powering the light emitting diodes (44, 144), and for removing heat from the light emitting diodes (44, 144), the largely planar structure (31, 131) comprising:

a printed circuit board (41); and a thermally conductive layer (43, 143) parallel to and adjacent to the printed circuit board (41); and a housing (21) for mechanically supporting the largely planar structure (31, 131), the housing (21) being in thermal contact with the thermally conductive layer (43, 143);

wherein the largely planar structure (31, 131) is insertable in the beam exiting direction through an aperture in the concave reflector (13);

wherein when the largely planar structure (31, 131) is fully inserted into the aperture in the concave reflector (13), the plurality of light emitting diodes (44, 144) are located at a focus of the concave reflector (13); and wherein when the largely planar structure (31, 131) is fully inserted into the aperture in the concave reflector (13), the housing (21) remains largely outside the concave reflector (13).

2. The automotive rear combination lamp (10) of claim 1, wherein the concave reflector (13) receives the diverging light directly from the plurality of light emitting diodes (44, 144).

3. The automotive rear combination lamp (10) of claim 1, wherein the concave reflector (13) receives the diverging light (12) from an intermediate reflection between the plurality of light emitting diodes (44, 144) and the concave reflector (13).

4. The automotive rear combination lamp of claim 3, wherein the intermediate reflection is formed by at least one intermediate reflector (45) attached to the printed circuit board (41).

5. The automotive rear combination lamp (10) of claim 1, wherein the thermally conductive layer (43, 143) is made integral with the housing (21).

6. The automotive rear combination lamp (10) of claim 1, wherein the thermally conductive layer (43, 143) is attached to the housing (21).

7. The automotive rear combination lamp (10) of claim 1, wherein the largely planar structure (31, 131) further comprises a thermal pad (42) disposed between the printed circuit board (41) and the thermally conductive layer (43, 143), for enhancing the thermal contact between the printed circuit board (41) and the thermally conductive layer (43, 143).

8. The automotive rear combination lamp (10) of claim 1, wherein the concave reflector (13) is an incomplete portion of a paraboloid.

9. The automotive rear combination lamp (10) of claim 1, wherein the concave reflector (13) includes a plurality of facets (19) for angularly diverting the collimated beam (14); and wherein the total angular diversions of all the facets (19) collectively forms a predetermined, two-dimensional angular distribution about the beam exiting direction.

10. The automotive rear combination lamp (10) of claim 1, further comprising:

an electrical connector (46) disposed on the printed circuit board (41);

wherein the electrical connector (46) includes a plurality of pins that extend generally anti-parallel to the beam exiting direction through an aperture in the housing (21).

11. The automotive rear combination lamp (10) of claim 1, wherein the thermally conductive layer (43, 143) and the printed circuit board (41) have essentially the same rectangular footprint.

12. An automotive rear combination lamp (10), comprising:

a housing (21) having a longitudinal axis;

a generally planar ledge (31, 131) longitudinally adjacent to the housing (21) and generally parallel to the longitudinal axis of the housing (21), the ledge (31, 131) comprising a plurality of layers, the plurality comprising:

a thermally conductive layer (43, 143) in thermal contact with the housing (21); and a printed circuit board (41) generally parallel to the thermally conductive layer (43, 143);

a plurality of light emitting diodes (44, 144) disposed on the printed circuit board (41), the diodes (44, 144) being capable of being electrically powered by the printed circuit board (41), the diodes (44, 144) being capable of generating heat that is dissipated by the thermally conductive layer (43, 143), the diodes (44, 144) being capable of generating light that propagates away from the printed circuit board (41); and a concave reflector (13) having a focus, the concave reflector (13) having an aperture at its vertex for receiving the housing (21), the ledge (31, 131) and the light emitting diodes (44, 144);

wherein when the housing (21), the ledge (31, 131) and the light emitting diodes (44, 144) are fully inserted into the aperture in the concave reflector (13), the light emitting diodes (44, 144) are located at the focus of the concave reflector (13); and wherein when the housing (21), the ledge (31, 131) and the light emitting diodes (44, 144) are fully inserted into the aperture in the concave reflector (13), light (12) emitted from the plurality of light emitting diodes (44, 144) diverges away from the printed circuit board (41), reflects off the concave reflector (13) to form a collimated beam (14), and exits the lamp (10) largely parallel to the longitudinal axis of the housing (21).

13. The automotive rear combination lamp (10) of claim 12, wherein the plurality of layers further comprises a thermal pad (42) disposed between the thermally conductive layer (43, 143) and the printed circuit board (41), for ensuring thermal contact between the thermally conductive layer (43, 143) and the printed circuit board (41).

14. The automotive rear combination lamp (10) of claim 12, wherein light that propagates away from the printed circuit board (41) propagates essentially perpendicular to the plane of the printed circuit board (41).

15. The automotive rear combination lamp (10) of claim 12, wherein light that propagates away from the printed circuit board (41) propagates essentially parallel to the plane of the printed circuit board (41).

16. The automotive rear combination lamp (10) of claim 12, wherein the concave reflector (13) is an incomplete portion of a paraboloid.

17. The automotive rear combination lamp (10) of claim 12, further comprising a clear cover (15) on an exiting face of the lamp (10), for transmitting the collimated beam (14).

* * * * *